US012753516B2

(12) United States Patent
Kimura et al.

(10) Patent No.: US 12,753,516 B2
(45) Date of Patent: Oct. 6, 2026

(54) PRODUCTION METHOD FOR ETCHING LIQUID COMPOSITION

(71) Applicant: Kao Corporation, Tokyo (JP)

(72) Inventors: Yosuke Kimura, Wakayama (JP); Kanji Sato, Tokyo (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 19/109,380

(22) PCT Filed: Sep. 6, 2023

(86) PCT No.: PCT/JP2023/032473
§ 371 (c)(1),
(2) Date: Mar. 6, 2025

(87) PCT Pub. No.: WO2024/053659
PCT Pub. Date: Mar. 14, 2024

(65) Prior Publication Data

US 2026/0002266 A1 Jan. 1, 2026

(30) Foreign Application Priority Data

Sep. 7, 2022 (JP) ..... 2022-142198

(51) Int. Cl.
*C23F 1/26* (2006.01)
*C23F 11/14* (2006.01)

(52) U.S. Cl.
CPC ..... *C23F 1/26* (2013.01); *C23F 11/141* (2013.01)

(58) Field of Classification Search
CPC ..... C23F 1/26; C23F 11/141
(Continued)

(56) References Cited

U.S. PATENT DOCUMENTS 5,942,449 A * 8/1999 Meikle ..... H10P 50/667 257/E21.309
6,329,300 B1 * 12/2001 Yamamoto ..... C23F 1/02 216/13

(Continued)

FOREIGN PATENT DOCUMENTS

JP 2000-144454 A 5/2000
JP 2000-188277 A 7/2000

(Continued)

OTHER PUBLICATIONS

Jang et al, TW 201716546 A, "Silver etching solution composition and display substrate using the same having a viscosity of 4 to 43 cP and a contact angle of 24 to 61 degrees", May 16, 2017, English machine translation. (Year: 2017).*

(Continued)

*Primary Examiner* — Anita K Alanko
(74) *Attorney, Agent, or Firm* — Birch, Stewart, Kolasch & Birch, LLP

(57) ABSTRACT

In one aspect, provided is a method for producing an etchant composition that is able to reduce dripping during the filling of a container with the etchant composition.
An aspect of the present disclosure relates to a method for producing an etchant composition. The etchant composition is used to etch a metal film that is disposed on a substrate. The method includes filling a container with the etchant composition by using a filling nozzle with a filling port through which the etchant composition is discharged. A receding contact angle of the etchant composition with respect to a raw material of the filling port of the filling nozzle is 60° or more, and the ratio of an advancing contact angle to a receding contact angle (advancing contact angle/receding contact angle) of the etchant composition is 1.4 or less.

13 Claims, 1 Drawing Sheet

(58) Field of Classification Search
USPC ..... 252/79.1–79.5
See application file for complete search history.

(56) References Cited

U.S. PATENT DOCUMENTS

| | | | | |
|---|---|---|---|---|
| 6,541,389 | B1 | 4/2003 | Kubo et al. | |
| 7,842,600 | B2 | 11/2010 | Yun et al. | |
| 2005/0218371 | A1* | 10/2005 | Giacobbe | C03B 37/027 252/70 |
| 2012/0187087 | A1 | 7/2012 | Ohshiro et al. | |
| 2016/0233082 | A1 | 8/2016 | Yano et al. | |
| 2017/0294332 | A1* | 10/2017 | LaBrie | H10P 72/78 |
| 2019/0194493 | A1 | 6/2019 | Yokoi et al. | |
| 2020/0148949 | A1* | 5/2020 | Xu | C09K 13/06 |
| 2020/0279752 | A1 | 9/2020 | Honda et al. | |
| 2022/0310401 | A1* | 9/2022 | Kitagawa | C23F 1/30 |

FOREIGN PATENT DOCUMENTS

| | | | | |
|---|---|---|---|---|
| JP | 2002-75186 | A | 3/2002 | |
| JP | 2007-305996 | A | 11/2007 | |
| JP | 2008-244205 | A | 10/2008 | |
| JP | 2009-218601 | A | 9/2009 | |
| JP | 2012-156248 | A | 8/2012 | |
| JP | 2013-237873 | A | 11/2013 | |
| JP | 2014-27274 | A | 2/2014 | |
| JP | 2015-88726 | A | 5/2015 | |
| JP | 2020-145412 | A | 9/2020 | |
| JP | 2022/140256 | A | 9/2022 | |
| JP | 2022-147744 | A | 10/2022 | |
| JP | 2022-150944 | A | 10/2022 | |
| JP | 2023-120855 | A | 8/2023 | |
| KR | 10-2011-0046992 | A | 5/2011 | |
| KR | 10-2016-0114887 | A | 10/2016 | |
| TW | 201716546 | A * | 5/2017 | C23F 1/30 |
| WO | WO 2019/026478 | A1 | 2/2019 | |
| WO | WO 2019/167635 | A1 | 9/2019 | |

OTHER PUBLICATIONS

Hu et al, "Dripping-jetting transition of liquid stream from plate-type micro-orifice affected by wetting an dewetting" Experimental Thermal and Fluid Science 122 (2021) 110302, available online Dec. 19, 2020. (Year: 2020).*

International Search Report, issued in PCT/JP2023/032473, PCT/ISA/210, dated Oct. 17, 2023.

Office Action issued in Japanese Patent Application No. 2023-144276 dated Jan. 23, 2025.

* cited by examiner

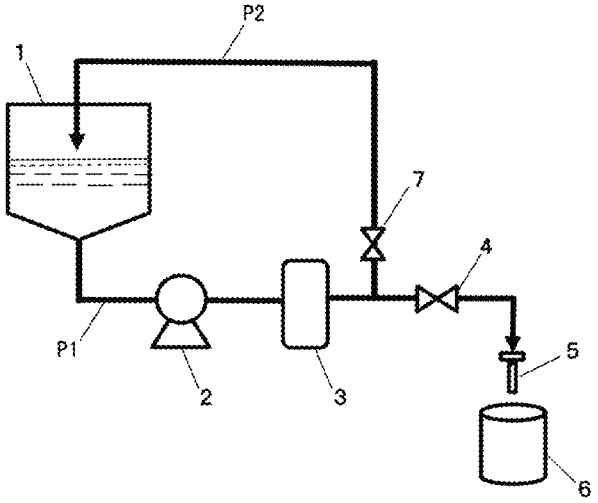
P2
1
7
4
P1
5
2
3
6

PRODUCTION METHOD FOR ETCHING LIQUID COMPOSITION

TECHNICAL FIELD

The present disclosure relates to a method for producing an etchant composition.

BACKGROUND ART

The manufacturing process of a semiconductor device includes a step of etching a film to be etched to form a predetermined pattern. The film to be etched contains at least one metal selected from, e.g., tungsten, tantalum, zirconium, hafnium, molybdenum, niobium, ruthenium, osmium, rhenium, rhodium, copper, nickel, cobalt, titanium, titanium nitride, alumina, aluminum, or iridium. In general, a mixed acid aqueous solution containing phosphoric acid, nitric acid, and acetic acid is used as an etchant.

In the field of semiconductor, wiring has been required to be finer and more complicated due to a high level of integration in recent years. There is also a growing demand for patterning technology and etchants, and a variety of etchant compositions and etching methods have been proposed.

For example, JP 2014-27274 A (Patent Document 1) proposes an etchant composition used for etching a Cu/Mo double-layer film. The etchant composition contains about 50 to 80% by weight of phosphoric acid, about 0.5 to 10% by weight of nitric acid, about 4 to 30% by weight of acetic acid, about 0.5 to 6% by weight of chlorine-containing compound, and the balance of water.

JP 2012-156248 A (Patent Document 2) proposes a method for etching a metal-laminated film composed of an alloy of copper and molybdenum and/or titanium by using an etchant composition containing 40 to 50% by weight of phosphoric acid, 1.5 to 3.5% by weight of nitric acid, 25 to 40% by weight of acetic acid, and water.

JP 2009-218601 A (Patent Document 3) proposes an etching composition for a thin film transistor liquid crystal display. The etching composition contains 55 to 70% by weight of phosphoric acid, 3 to 15% by weight of nitric acid, 5 to 20% by weight of acetic acid, 0.5 to 10% by weight of phosphate, 0.1 to 5% by weight of chlorine compound, 0.01 to 4% by weight of azole compound, and the balance of water.

JP 2008-244205 A (Patent Document 4) proposes an etchant composition used for etching a multilayer metal film to form a predetermined pattern. The multilayer metal film includes an aluminum film or an aluminum alloy that is formed on a substrate, and a molybdenum that is formed on the surface of the aluminum film or the aluminum alloy film. The etchant composition contains phosphoric acid with a concentration of 40 to 70% by mass, nitric acid with a concentration of 0.5 to 10% by mass, acetic acid with a concentration of 50 to 15% by mass, and the balance of water.

JP 2007-305996 A (Patent Document 5) proposes an etching composition for a thin film transistor liquid crystal display. The etching composition contains 50 to 80% by weight of phosphoric acid, 2 to 15% by weight of nitric acid, 3 to 20% by weight of acetic acid, 0.05 to 3% by weight of lithium compound, 0.1 to 5% by weight of phosphate compound, and the balance of water.

DISCLOSURE OF THE INVENTION

An aspect of the present disclosure relates to a method for producing an etchant composition. The etchant composition is used to etch a metal film that is disposed on a substrate. The method includes filling a container with the etchant composition by using a filling nozzle with a filling port through which the etchant composition is discharged. A receding contact angle of the etchant composition with respect to a raw material of the filling port of the filling nozzle is 60° or more, and the ratio of an advancing contact angle to a receding contact angle (advancing contact angle/receding contact angle) of the etchant composition is 1.4 or less.

An aspect of the present disclosure relates to a mixed acid composition used for the method for producing an etchant composition of the present disclosure. The mixed acid composition contains phosphoric acid, nitric acid, and organic acid.

An aspect of the present disclosure relates to an etchant composition in a container, including the etchant composition with which the container is filled. The etchant composition is used to etch a metal film that is disposed on a substrate. The etchant composition contains phosphoric acid, nitric acid, organic acid, an etching inhibitor, and water and has a viscosity of 11 mPa·s or more and less than 40 mPa·s at 25° C. A receding contact angle of the etchant composition with respect to a raw material of the container is 60° or more, and the ratio of an advancing contact angle to a receding contact angle (advancing contact angle/receding contact angle) of the etchant composition is 1.4 or less.

An aspect of the present disclosure relates to use of a mixed acid composition containing phosphoric acid, nitric acid, and organic acid for the method for producing an etchant composition of the present disclosure.

BRIEF DESCRIPTION OF DRAWINGS

FIG. 1 is a schematic diagram illustrating an embodiment of a filling system.

DESCRIPTION OF THE INVENTION

An etchant composition is usually put in a container and prepared for market. The etchant composition is subjected to filtration using. e.g., a filter before being filled into the container in order to reduce the content of foreign matter (particles) in the etchant composition. For this reason, the etchant needs to improve the filter permeability and to increase the filtration rate.

In some cases, the etchant may drip as it is introduced into the container. The more dripping occurs, the longer it takes to wipe off the drips, leading to lower productivity. Thus, the etchant also needs to be resistant to dripping in terms of improving the productivity. Moreover, the etchant in the container needs to be resistant to dripping when taken out of the container.

With the foregoing in mind, in one aspect, the present disclosure provides a method for producing an etchant composition that is able to reduce dripping during the filling of a container with the etchant composition. In one aspect, the present disclosure provides a method for producing an etchant composition that is able to reduce dripping during the filling of a container with the etchant composition and also to increase the filtration rate. In one aspect, the present disclosure provides an etchant composition in a container that is able to reduce dripping when the etchant composition is taken out of the container.

In one aspect, the present disclosure can provide the method for producing an etchant composition that is able to reduce dripping during the filling of a container with the etchant composition. In one aspect, the present disclosure can provide the method for producing an etchant composition that is able to reduce dripping during the filling of a container with the etchant composition and also to increase the filtration rate. In one aspect, the present disclosure can provide the etchant composition in a container that is able to reduce dripping when the etchant composition is taken out of the container.

In one aspect, the present disclosure is based on the findings that it is possible to reduce dripping when a container is filled with an etchant and to increase the filtration rate, provided that the contact angles (receding contact angle, advancing contact angle/receding contact angle) of the etchant with respect to the raw material of a filling port are adjusted within a predetermined range.

In one aspect, the present disclosure relates to a method for producing an etchant composition (also referred to as a "production method of an etchant in the aspect 1" in the following). The etchant composition is used to etch a metal film that is disposed on a substrate (also referred to as an "etchant composition of the present disclosure" in the following). The method includes filling a container with the etchant composition by using a filling nozzle with a filling port through which the etchant composition is discharged (also referred to as a "filling process" in the following). A receding contact angle of the etchant composition with respect to a raw material of the filling port of the filling nozzle is 60° or more, and the ratio of an advancing contact angle to a receding contact angle (advancing contact angle/receding contact angle) of the etchant composition is 1.4 or less.

In one or more embodiments, the aspect 1 can reduce dripping during the filling of the container with the etchant composition. Moreover, in one or more embodiment, the aspect 1 can achieve both the reduced dripping during the filling of the container with the etchant composition and the increased filtration rate.

The details of the mechanism of the effect of the aspect 1 are not fully clear, but can be assumed as follows.

The same liquid that meets both of the following conditions can improve the productivity: (i) the receding contact angle is a predetermined value or more to reduce the number of times dripping occurs; and (ii) the ratio of the advancing contact angle to the receding contact angle is a predetermined value or less to balance the permeability (filtration rate) with the resistance to dripping. When the receding contact angle is high to some extent, and the ratio of the advancing contact angle to the receding contact angle is within a certain range, these aspects may be effective in improving the productivity in an etching process (e.g., a process of treating an electronic member by etching or a process of preparing for etching).

However, the present disclosure should not be interpreted solely by the above mechanism.

In another aspect, the present disclosure is based on the findings that it is possible to reduce dripping when a container is filled with an etchant and to increase the filtration rate, provided that the etchant contains phosphoric acid, nitric acid, organic acid, an etching inhibitor, and water and has a viscosity within a predetermined range at 25° C.

In another aspect, the present disclosure relates to a method for producing an etchant composition with which a container is filled (also referred to as a "production method of an etchant in the aspect 2" in the following). The etchant composition is used to etch a metal film that is disposed on a substrate (also referred to as an "etchant composition of the present disclosure" in the following). The etchant composition contains phosphoric acid, nitric acid, organic acid, an etching inhibitor, and water and has a viscosity of 11 mPa·s or more and less than 40 mPa·s at 25° C. The method includes filling a container with the etchant composition (also referred to as a "filling process" in the following).

In one or more embodiments, the aspect 2 can achieve both the reduced dripping during the filling of the container with the etchant composition and the increased filtration rate.

The details of the mechanism of the effect of the aspect 2 are not fully clear, but can be assumed as follows.

The etchant composition in the aspect 2 has a viscosity within a predetermined range, and thus can reduce dripping during the filling of the container with the etchant composition. Moreover, the etchant composition in the aspect 2 contains organic acid, and thus can prevent the formation of submicron-sized particles due to rapid neutralization of the strong acid (phosphoric acid, nitric acid) and the etching inhibitor. This may improve the filter permeability and increase the filtration rate.

However, the present disclosure should not be interpreted solely by the above mechanism.

The production methods of an etchant in the aspects 1 and 2 are also collectively referred to as a "production method of an etchant of the present disclosure" in the following.

Filling Process

The production method of an etchant of the present disclosure includes filling a container with the etchant composition of the present disclosure (i.e., a filling process). In one or more embodiments, the filling process uses a filling nozzle with a filling port, through which the etchant composition is discharged, to fill the container with the etchant composition.

In the filling process, a method for filling the container with the etchant composition is not particularly limited and may be a conventionally known method, depending on, e.g., the form of the container.

In the filling process, the etchant composition may be filled into the container through, e.g., a filling system as illustrated in FIG. 1, but the filling method is not limited to the filling system.

In one or more embodiments, as illustrated in FIG. 1, the filling system includes a tank 1 for storing the etchant composition, a pump 2 for delivering the etchant composition, a filter 3 for filtering the etchant composition, an outlet valve 4 for controlling the flow rate of the etchant composition that is discharged from an outlet (filling nozzle) 5, and a pipe P1 for connecting the tank 1, the pump 2, the filter 3, the outlet valve 4, and the outlet (filling nozzle) 5. The filling system also includes a circulation path P2 that branches off from the pipe P1 between the filter 3 and the outlet valve 4 and is connected to the upstream side of the pump 2. In one or more embodiments, the filling system further includes a circulation valve 7 for controlling the flow rate of the etchant composition that is circulated in the circulation path P2.

In one or more embodiments, the filling system is configured to supply the etchant composition in the tank 1 by the pump 2, to filter the etchant composition through the filter 3, to open the outlet valve 4 to allow the etchant composition to be discharged from the outlet (filling nozzle) 5 and filled into a container 6, and to open the circulation valve 7 to allow the etchant composition to be circulated in the circulation path P2 while the outlet valve 4 is being opened or closed.

In one or more embodiments, the pump 2 forces the etchant composition in the tank 1 to flow into the pipe P1. The type of the pump is not particularly limited and may be, e.g., a diaphragm pump. In one or more embodiments, the pump 2 is stopped when both the circulation valve 7 and the outlet valve 4 are closed.

In one or more embodiments, the filter 3 is used for filtration of the etchant composition. Examples of the filter 3 include conventional filters such as a membrane filter, a pleated filter, a depth filter, and a filter aid-containing filter. These filters may be used in combination. The number of stages of the filter 3 is, e.g., 1 to 5.

In one or more embodiments, the outlet 5 is a filling nozzle with a filling port through which the etchant composition is discharged.

In FIG. 1, the circulation path P2 is configured to connect the downstream side of the filter 3 to the tank 1. However, the circulation path P2 is not limited to this configuration as long as it can connect the downstream side of the filter 3 to the upstream side of the pump 2. For example, the circulation path P2 may be configured to return from the downstream side of the filter 3 to the pipe P1 between the tank 1 and the pump 2.

In FIG. 1, the outlet valve 4 and the circulation valve 7 are provided separately. Instead of these two valves, a three-way valve may be placed at a branch point of the pipe P1 and the circulation path P2 to switch the flow path of the etchant composition.

In FIG. 1, the filling system is configured to circulate the etchant by using the circulation path P2 and the circulation valve 7. However, the filling system may be configured not to include the circulation path P2 and the circulation valve 7 (i.e., not to circulate the etchant).

Filling Nozzle

The filling nozzle used in the filling process may be any nozzle that allows the container to be filled with the etchant, and may have any shape, size, etc.

The outer diameter of the filling port of the filling nozzle is, e.g., 5 mm to 1000 mm.

The raw material (material) of the filling port of the filling nozzle is preferably at least one selected from polypropylene (PP), PFA (perfluoroalkoxyalkane), or PTFE (polytetrafluoroethylene) from the viewpoint of reducing dripping. Among them, PFA and PTFE are more preferred.

Container

The container to be filled with the etchant composition is made of, e.g., polyethylene resin, polypropylene resin, or fluororesin. Examples of the polyethylene resin include low-density polyethylene, medium-density polyethylene, high-density polyethylene, and mixtures thereof. Examples of the fluororesin include PFA (perfluoroalkoxyalkane), PTFE (polytetrafluoroethylene), and mixtures thereof. Among them, the raw material (material) of the container is preferably at least one selected from polypropylene (PP), PFA (perfluoroalkoxyalkane), or PTFE (polytetrafluoroethylene), and more preferably PFA and PTFE from the viewpoint of reducing dripping.

In the present disclosure, the "container made of polyethylene resin or polypropylene resin" means a container in which at least the portion that comes into contact with the etchant composition is made of polyethylene resin or polypropylene resin. The resin container of the present disclosure may have a layered structure with an inner layer of polyethylene resin or polypropylene resin, which comes into contact with the etchant composition, and an outer layer of another resin.

In general, some commercially available polyethylene or polypropylene containers may be composed of an antistatic agent such as a surfactant or a metal oxide. On the other hand, polyethylene or polypropylene containers free of the antistatic agent are suitable for the etchant composition of the present disclosure.

Since the etchant composition of the present disclosure contains nitric acid as an essential component, gray or blue colored containers or light-resistant containers are preferred to translucent or white containers in order to prevent degradation due to sunlight or the like.

The container of the present disclosure may be in various forms, including, e.g., the following: a resin container with a capacity of 0.1 to 30 L; a composite container having a resin inner container with a capacity of 0.1 to 30 L in combination with a cardboard box; a composite container having a resin inner container with a capacity of 1 to 30 L in combination with a metal can; a resin drum with a capacity of 20 to 300 L; a composite container having a resin inner container with a capacity of 20 to 300 L in combination with a metallic drum; a composite container having a resin inner container with a capacity of 500 to 1200 L in combination with a metal container; and an ISO container tank of 1000 L or more.

The container of the present disclosure may be intended for storage or transport of the etchant composition, and can be produced by, e.g., injection molding, extrusion molding, or rotational molding.

In one or more embodiments, a nozzle (filling nozzle) for filling the container with the etchant composition has an outlet diameter (i.e., the outer diameter of the filling port) of, e.g., 14 mm.

Etchant Composition

In one or more embodiments, the etchant composition of the present disclosure contains phosphoric acid, nitric acid, organic acid, an etching inhibitor, and water. In another one or more embodiments, the etchant composition of the present disclosure contains phosphoric acid, nitric acid, organic acid, an etching inhibitor, and water and has a viscosity of 11 mPa·s or more and less than 40 mPa·s at 25° C.

Contact Angle of Etchant with Respect to Raw Material (Material) of Filling Port of Filling Nozzle The advancing contact angle of the etchant composition of the present disclosure with respect to the raw material of the filling port of the filling nozzle is preferably 70° or more, more preferably 75° or more, and further preferably 79° or more from the viewpoint of reducing dripping. The advancing contact angle is preferably 120° or less, more preferably 100° or less, and further preferably 95° or less from the viewpoint of productivity. From the same viewpoint, the advancing contact angle is preferably 70° or more and 120° or less, more preferably 75° or more and 100° or less, and further preferably 79° or more and 100° or less.

The receding contact angle of the etchant composition of the present disclosure with respect to the raw material of the filling port of the filling nozzle is 60° or more, preferably 66° or more, and more preferably 70° or more from the viewpoint of reducing dripping. The receding contact angle is preferably 100° or less, more preferably 92° or less, and further preferably 85° or less from the viewpoint of productivity. From the same viewpoint, the receding contact angle is preferably 60° or more and 100° or less, more preferably 66° or more and 92° or less, and further preferably 70° or more and 85° or less.

The ratio of the advancing contact angle to the receding contact angle (advancing contact angle/receding contact angle) of the etchant composition of the present disclosure with respect to the raw material of the filling port of the filling nozzle is 1.4 or less, preferably 1.3 or less, and more preferably 1.2 or less from the viewpoint of reducing dripping.

In the present disclosure, the contact angles (advancing contact angle and receding contact angle) of the etchant with respect to the raw material of the filling port of the filling nozzle can be measured with a contact angle measuring device (e.g., K-100 manufactured by KRUSS GmbH) in an environment of 25° C. Specifically, the contact angles can be measured by a method as described in Examples.

Phosphoric Acid

The blending amount of phosphoric acid in the etchant composition of the present disclosure is preferably 10% by mass or more, more preferably 15% by mass or more, and further preferably 20% by mass or more from the viewpoint of reducing etching nonuniformity. Furthermore, the blending amount of phosphoric acid is preferably 90% by mass or less, more preferably 80% by mass or less, and further preferably 70% by mass or less from the viewpoint of reducing etching nonuniformity. More specifically, the blending amount of phosphoric acid is preferably 10% by mass or more and 90% by mass or less, more preferably 15% by mass or more and 80% by mass or less, and further preferably 20% by mass or more and 70% by mass or less.

Nitric Acid

The blending amount of nitric acid in the etchant composition of the present disclosure is preferably 0.5% by mass or more, more preferably 1% by mass or more, even more preferably 2% by mass or more, still more preferably 3% by mass or more, and further preferably 4% by mass or more from the viewpoint of improving the etching rate. Furthermore, the blending amount of nitric acid is preferably 20% by mass or less, more preferably 10% by mass or less, even more preferably 7% by mass or less, and further preferably 6% by mass or less from the viewpoint of reducing etching nonuniformity. More specifically, the blending amount of nitric acid is preferably 0.5% by mass or more and 20% by mass or less, more preferably 1% by mass or more and 10% by mass or less, even more preferably 2% by mass or more and 7% by mass or less, still more preferably 3% by mass or more and 6% by mass or less, and further preferably 4% by mass or more and 6% by mass or less.

Organic Acid

Examples of the organic acid contained in the etchant composition of the present disclosure include at least one selected from the group consisting of formic acid, acetic acid, propionic acid, butyric acid, oxalic acid, malonic acid, succinic acid, glutaric acid, adipic acid, pimelic acid, maleic acid, fumaric acid, phthalic acid, trimellitic acid, hydroxyacetic acid, lactic acid, salicylic acid, malic acid, tartaric acid, citric acid, aspartic acid, and glutamic acid. The organic acid is preferably monovalent organic acid having 1 to 10 carbon atoms, more preferably monovalent carboxylic acid having 1 to 10 carbon atoms, and further preferably a compound containing acetic acid from the viewpoint of reducing dripping during the filling of the container with the etchant composition and increasing the filtration rate. The organic acid may be used alone or in combination of two or more.

The blending amount of organic acid in the etchant composition of the present disclosure is preferably 11% by mass or more, more preferably 15% by mass or more, and further preferably 20% by mass or more from the viewpoint of reducing etching nonuniformity. Furthermore, the blending amount of organic acid is preferably 59% by mass or less, more preferably 50% by mass or less, and further preferably 40% by mass or less from the viewpoint of increasing the filtration rate. More specifically, the blending amount of organic acid is preferably 11% by mass or more and 59% by mass or less, more preferably 15% by mass or more and 50% by mass or less, and further preferably 20% by mass or more and 40% by mass or less. When the organic acid is a combination of two or more types, the blending amount of the organic acid is the total amount of the two or more types.

The total amount of phosphoric acid, nitric acid, and organic acid in the etchant composition of the present disclosure is preferably 70% by mass or more, more preferably 75% by mass or more, and further preferably 80% by mass or more from the viewpoint of reducing etching nonuniformity. From the same viewpoint, the total amount of phosphoric acid, nitric acid, and organic acid is preferably 99.9% by mass or less, more preferably 99% by mass or less, and further preferably 98% by mass or less. More specifically, the total amount of phosphoric acid, nitric acid, and organic acid is preferably 70% by mass or more and 99.9% by mass or less, more preferably 75% by mass or more and 99% by mass or less, and further preferably 80% by mass or more and 98% by mass or less.

In one or more embodiments, the acid contained in the etchant composition of the present disclosure includes phosphoric acid, nitric acid, and organic acid. From the viewpoint of reducing dripping during the filling of the container with the etchant composition and increasing the filtration rate, the acid of the etchant composition preferably includes phosphoric acid, nitric acid, and acetic acid, and more preferably is a mixed acid consisting of phosphoric acid, nitric acid, and acetic acid.

When the acid of the etchant composition is a mixed acid consisting of phosphoric acid, nitric acid, and acetic acid, the added amount of phosphoric acid in the mixed acid is preferably 10% by mass or more and 95% by mass or less, more preferably 20% by mass or more and 93% by mass or less, and further preferably 30% by mass or more and 90% by mass or less from the viewpoint of reducing etching nonuniformity. From the same viewpoint, the added amount of nitric acid in the mixed acid is preferably 0.5% by mass or more and 20% by mass or less, more preferably 1% by mass or more and 15% by mass or less, and further preferably 1.5% by mass or more and 10% by mass or less. From the same viewpoint, the added amount of acetic acid in the mixed acid is preferably 2% by mass or more and 80% by mass or less, more preferably 5% by mass or more and 70% by mass or less, and further preferably 15% by mass or more and 60% by mass or less. The mass ratio of the phosphoric acid, the nitric acid, and the acetic acid (phosphoric acid/nitric acid/acetic acid) can be appropriately determined and may be, e.g., 57/6/37. In one or more embodiments, the added amount of each component in the mixed acid may be considered as the content of each component in the mixed acid.

Etching Inhibitor

The etchant composition of the present disclosure may contain only one type of etching inhibitor or two or more types of etching inhibitors.

In one or more embodiments, the etching inhibitor of the present disclosure is at least one nitrogen-containing compound selected from the group consisting of polyalkyleneimine and polyalkylene polyamine. The polyalkyleneimine may be, e.g., polyethyleneimine (PEI). The polyalkylene polyamine may be, e.g., pentaethylenehexamine, diethylenetriamine, triethylenetetramine, or tetraethylenepentamine.

When the etching inhibitor is polyalkyleneimine, the number average molecular weight of the etching inhibitor is preferably 300 or more, more preferably 600 or more, and further preferably 1,200 or more from the viewpoint of reducing etching nonuniformity and improving the storage stability and the filtration rate. Furthermore, the number average molecular weight of the etching inhibitor is preferably 100,000 or less, more preferably 5,000 or less, and further preferably 3,000 or less from the viewpoint of viscosity. More specifically, the number average molecular weight of the etching inhibitor is preferably 300 or more and 100,000 or less, more preferably 600 or more and 5,000 or less, and further preferably 1,200 or more and 3,000 or less.

When the etching inhibitor is polyalkylene polyamine, the number average molecular weight or the molecular weight of the etching inhibitor is preferably 50 or more, more preferably 80 or more, and further preferably 100 or more from the viewpoint of reducing etching nonuniformity and improving the storage stability and the filtration rate. From the same viewpoint, the number average molecular weight or the molecular weight of the etching inhibitor is preferably 1,000 or less, more preferably 500 or less, and further preferably 300 or less. More specifically, the number average molecular weight or the molecular weight of the etching inhibitor is preferably 50 or more and 1,000 or less, more preferably 80 or more and 500 or less, and further preferably 100 or more and 300 or less.

In the present disclosure, the average molecular weight can be measured by gel permeation chromatography (GPC).

The following is an example of the measurement method of the average molecular weight of the etching inhibitor of the present disclosure.

GPC Conditions (Polyalkyleneimine)

Sample solution: solution adjusted to a concentration of 0.1 wt %

Device/Detector: HLC-8320GPC (integrated GPC) manufactured by Tosoh Corporation

Column: α-M+α-M (manufactured by Tosoh Corporation)

Eluent: 0.15 mol/L $Na_2SO_4$, 1% $CH_3COOH$/water

Column temperature: 40° C.

Flow rate: 1.0 mL/min

Injection volume of sample solution: 100 μL

Standard polymer: pullulan with a known molecular weight (P-5, P-50, P-200, and P-800 by Shodex)

The blending amount of the etching inhibitor in the etchant composition of the present disclosure is preferably 0.01% by mass or more, more preferably 0.1% by mass or more, and further preferably 0.5% by mass or more from the viewpoint of reducing etching nonuniformity. From the same viewpoint, the blending amount of the etching inhibitor is preferably 10% by mass or less, more preferably 5% by mass or less, and further preferably 3% by mass or less. More specifically, the blending amount of the etching inhibitor is preferably 0.01% by mass or more and 10% by mass or less, more preferably 0.1% by mass or more and 5% by mass or less, and further preferably 0.5% by mass or more and 3% by mass or less. When the etching inhibitor is a combination of two or more types, the blending amount of the etching inhibitor is the total amount of the two or more types.

Water

In one or more embodiments, the etchant composition of the present disclosure contains water. The water contained in the etchant composition may be, e.g., distilled water, ion-exchanged water, pure water, or ultrapure water.

The blending amount of water in the etchant composition of the present disclosure is preferably 2% by mass or more, more preferably 5% by mass or more, and further preferably 7% by mass or more from the viewpoint of reducing etching nonuniformity. From the same viewpoint, the blending amount of water is preferably 30% by mass or less, more preferably 25% by mass or less, and further preferably 20% by mass or less. More specifically, the blending amount of water is preferably 2% by mass or more and 30% by mass or less, more preferably 5% by mass or more and 25% by mass or less, and further preferably 7% by mass or more and 20% by mass or less.

Other Components

The etchant composition of the present disclosure may further contain other components to the extent that they do not interfere with the effects of the present disclosure. The other components include, e.g., inorganic acid other than phosphoric acid and nitric acid, a chelating agent, a surface-active agent, a solubilizing agent, an antiseptic, an anticorrosive, a bactericide, an antibacterial agent, and an antioxidant.

It is preferable that the etchant composition of the present disclosure does not contain an azole compound from the viewpoint of reducing etching nonuniformity. In the context of the present disclosure, in one or more embodiments, the phrase "not containing an azole compound" means any of the following: (i) the etchant composition does not contain an azole compound; (ii) the etchant composition does not substantially contain an azole compound; and (iii) the etchant composition does not contain an amount of azole compound that would affect the etching results. Specifically, the blending amount of the azole compound in the etchant composition of the present disclosure is not particularly limited, but is preferably less than 0.01% by mass, more preferably 0.001% by mass or less, and further preferably 0% by mass (i.e., no azole compound is contained).

It is preferable that the etchant composition of the present disclosure does not contain a chlorine containing compound from the viewpoint of reducing etching nonuniformity. In the context of the present disclosure, in one or more embodiments, the phrase "not containing a chlorine-containing compound" means any of the following: (i) the etchant composition does not contain a chlorine-containing compound; (ii) the etchant composition does not substantially contain a chlorine-containing compound; and (iii) the etchant composition does not contain an amount of chlorine-containing compound that would affect the etching results. Specifically, the blending amount of the chlorine-containing compound in the etchant composition of the present disclosure is not particularly limited, but is preferably less than 0.1% by mass, more preferably 0.001% by mass or less, and further preferably 0% by mass (i.e., no chlorine-containing compound is contained).

It is preferable that the etchant composition of the present disclosure does not contain or is not made up of a phosphate compound from the viewpoint of reducing etching nonuniformity. In the context of the present disclosure, in one or more embodiments, the phrase "not containing or not being made up of a phosphate compound" means any of the following: (i) the etchant composition does not contain or is not made up of a phosphate compound; (ii) the etchant composition does not substantially contain or is not substantially made up of a phosphate compound; and (iii) the etchant composition does not contain or is not made up of an amount of phosphate compound that would affect the etching results. Specifically, the blending amount of the phosphate compound in the etchant composition of the present disclosure is not particularly limited, but is preferably less than 0.1% by mass, more preferably 0.001% by mass or less, and further preferably 0% by mass (i.e., no phosphate compound is contained).

It is preferable that the etchant composition of the present disclosure does not contain hydrogen peroxide from the viewpoint of reducing etching nonuniformity. In the context of the present disclosure, in one or more embodiments, the phrase "not containing hydrogen peroxide" means any of the following: (i) the etchant composition does not contain hydrogen peroxide; (ii) the etchant composition does not substantially contain hydrogen peroxide; and (iii) the etchant composition does not contain an amount of hydrogen peroxide that would affect the etching results. Specifically, the blending amount of the hydrogen peroxide in the etchant composition of the present disclosure is not particularly limited, but is preferably 3% by mass or less, more preferably 1% by mass or less, even more preferably 0.1% by mass or less, still more preferably 0.01% by mass or less, yet more preferably 0.001% by mass or less, and further preferably 0% by mass (i.e., no hydrogen peroxide is contained).

It is preferable that the etchant composition of the present disclosure does not contain a fluorine compound from the viewpoint of reducing etching nonuniformity. In the context of the present disclosure, in one or more embodiments, the phrase "not containing a fluorine compound" means any of the following: (i) the etchant composition does not contain a fluorine compound; (ii) the etchant composition does not substantially contain a fluorine compound; and (iii) the etchant composition does not contain an amount of fluorine compound that would affect the etching results. Specifically, the blending amount of the fluorine compound in the etchant composition of the present disclosure is not particularly limited, but is preferably 3% by mass or less, more preferably 1% by mass or less, even more preferably 0.1% by mass or less, still more preferably 0.01% by mass or less, yet more preferably 0.001% by mass or less, and further preferably 0% by mass (i.e., no fluorine compound is contained).

In one or more embodiments, the etchant composition of the present disclosure can be produced by blending phosphoric acid, nitric acid, organic acid, an etching inhibitor, and water, and the optional components as desired, with a known method. Thus, in one or more embodiments, the production method of an etchant of the present disclosure may include blending at least phosphoric acid, nitric acid, organic acid, an etching inhibitor, and water.

In the context of the present disclosure, in one or more embodiments, the phrase "blending at least phosphoric acid, nitric acid, organic acid, an etching inhibitor, and water" includes mixing the phosphoric acid, the nitric acid, the organic acid, the etching inhibitor, and water, and the optional components as needed, simultaneously or in sequence. They can be mixed in any order. The blending can be performed by using, e.g., a propeller agitator, liquid circulation stirring with a pump, or mixers such as a homomixer, a homogenizer, an ultrasonic disperser, and a wet ball mill.

The preferred blending amount of each component in the production method of an etchant of the present disclosure may be the same as the preferred blending amount of each component in the etchant composition of the present disclosure, as described above.

In the context of the present disclosure, in one or more embodiments, the phrase "blending amount of each component in the etchant composition" means the amount of each component in the etchant composition that is to be used in the etching process, i.e., the amount of each component in the etchant composition at the time the etchant composition starts to be used in an etching treatment (at the time of use).

In one or more embodiments, the blending amount of each component in the etchant composition of the present disclosure may be considered as the content of each component in the etchant composition. However, the blending amount of each component may differ from the content of each component depending on the effect of neutralization.

In one or more embodiments, the etchant composition of the present disclosure can be produced by blending a mixed acid composition containing phosphoric acid, nitric acid, and organic acid with an etching inhibitor. Thus, in one or more embodiments, the production method of an etchant of the present disclosure may include blending a mixed acid composition containing phosphoric acid, nitric acid, and organic acid with an etching inhibitor to provide the etchant composition. The mixed acid composition may contain water, and optionally the other components as described above. The mixed acid composition and the etching inhibitor may be blended using any of the above mixers.

The blending amount of phosphoric acid in the mixed acid composition is preferably 10% by mass or more and 95% by mass or less, more preferably 20% by mass or more and 93% by mass or less, and further preferably 30% by mass or more and 90% by mass or less from the viewpoint of reducing etching nonuniformity.

From the same viewpoint, the blending amount of nitric acid in the mixed acid composition is preferably 0.5% by mass or more and 20% by mass or less, more preferably 1% by mass or more and 15% by mass or less, and further preferably 1.5% by mass or more and 10% by mass or less.

From the same viewpoint, the blending amount of organic acid in the mixed acid composition is preferably 2% by mass or more and 80% by mass or less, more preferably 5% by mass or more and 70% by mass or less, and further preferably 15% by mass or more and 60% by mass or less.

The mass ratio of the phosphoric acid, the nitric acid, and the organic acid (phosphoric acid/nitric acid/organic acid) in the mixed acid composition is preferably 10 to 95/0.5 to 20/2 to 80, more preferably 20 to 93/1 to 15/5 to 70, and further preferably 30 to 80/1.5 to 10/15 to 60.

The blending amount of water in the mixed acid composition is preferably 1% by mass or more and 30% by mass or less, more preferably 3% by mass or more and 25% by mass or less, and further preferably 5% by mass or more and 20% by mass or less from the viewpoint of etching characteristics.

In one or more embodiments, the mixed acid composition is used to produce the etchant composition of the present disclosure. Thus, in one aspect, the present disclosure relates to a mixed acid composition used for the production method of an etchant of the present disclosure. The mixed acid composition contains phosphoric acid, nitric acid, and organic acid Moreover, in one aspect, the present disclosure relates to use of a mixed acid composition containing phosphoric acid, nitric acid, and organic acid for the production method of an etchant of the present disclosure.

An embodiment of the etchant composition of the present disclosure may be either a so-called one-part or two-part etchant composition. The one-part etchant composition is supplied to the market with all the components being mixed together. On the other hand, the components of the two-part etchant composition are mixed at the time of use. The two-part etchant composition may include a first solution and a second solution, which are composed of water. Each of phosphoric acid, nitric acid, organic acid, and an etching inhibitor may be added to either or both of the first solution and the second solution. The first solution and the second solution may be mixed at the time of use. Each of the first solution and the second solution may contain the above optional components as needed.

The pH of the etchant composition of the present disclosure is preferably 1 or less, more preferably 0 or less, even more preferably less than 0, and further preferably about −1 from the viewpoint of reducing etching nonuniformity. The pH of the etchant composition may be preferably −5 or more, and more preferably −3 or more. In the present disclosure, the pH of the etchant composition is a value at a temperature of 25° C. and can be measured with a pH meter. Specifically, the pH of the etchant composition can be measured by a method as described in Examples.

The viscosity of the etchant composition of the present disclosure is preferably 11 mPa·s or more, more preferably 13 mPa·s or more, and further preferably 20 mPa·s or more at 25° C. from the viewpoint of reducing dripping. Furthermore, the viscosity of the etchant composition is preferably less than 40 mPa·s, more preferably 39 mPa·s or less, and further preferably 38 mPa·s or less at 25° C. from the viewpoint of increasing the filtration rate. More specifically, the viscosity of the etchant composition is preferably 11 mPa·s or more and less than 40 mPa·s, more preferably 13 mPa·s or more and 39 mPa·s or less, and further preferably 20 mPa·s or more and 38 mPa·s or less at 25° C. In the present disclosure, the viscosity of the etchant composition can be measured with a general viscometer such as a B-type viscometer or an Ubbelohde viscometer. Specifically, the viscosity of the etchant composition can be measured by a method as described in Examples. The viscosity of the etchant composition at 25° C. may be adjusted with, e.g., water or an organic solvent.

The etchant composition of the present disclosure may be concentrated so as not to impair the storage stability, and stored and supplied in the concentrated state. This can reduce the production and transportation costs. If necessary, the concentrated solution may be appropriately diluted with water or an acid aqueous solution and used in the etching process. The dilution factor may be, e.g., 3 to 100.

Film to be Etched

The film to be etched with the etchant composition of the present disclosure is a metal film formed on a substrate (also referred to as a "metal film to be etched" in the following).

In one or more embodiments, the substrate is at least one substrate selected from the group consisting of a semiconductor wafer, a substrate for a liquid crystal display, a substrate for a plasma display, a substrate for an FED (field emission display), a substrate for an optical disk, a substrate for a magnetic disk, a substrate for a magneto-optical disk, a substrate for a photomask, a ceramic substrate, and a substrate for a solar cell.

In one or more embodiments, the metal film to be etched contains at least one metal. The metal film to be etched is not particularly limited as long as the effects of the present disclosure are obtained, and may be, e.g., a metal film containing at least one metal selected from the group consisting of tungsten, tantalum, zirconium, hafnium, molybdenum, niobium, ruthenium, osmium, rhenium, rhodium, copper, nickel, cobalt, titanium, titanium nitride, alumina, aluminum, and iridium. In one or more embodiments, the metal film to be etched does not contain copper or aluminum.

In one or more embodiments, the etchant composition of the present disclosure is preferably used to etch the metal film (free of copper and aluminum) containing at least one metal selected from the group consisting of tungsten, tantalum, zirconium, molybdenum, niobium, and nickel. In one or more embodiments the etchant composition is preferably used to etch a tungsten film, a molybdenum film, or a nickel film. Thus, in one or more embodiments, the film to be etched may be a tungsten film, a molybdenum film, or a nickel film.

Kit

In one aspect, the present disclosure relates to a kit for producing the etchant composition of the present disclosure (also referred to as a "kit of the present disclosure" in the following).

In one or more embodiments, the kit of the present disclosure may be a kit (two-part etchant) that includes a first solution and a second solution so that the two solutions are not mixed with each other. Each of phosphoric acid, nitric acid, organic acid, and an etching inhibitor is added to either or both of the first solution and the second solution. The first solution and the second solution are mixed at the time of use. After the first solution and the second solution are mixed together, the mixed solution may be diluted with water or an acid aqueous solution as needed. The first solution or the second solution may contain the whole or part of the amount of water used for the preparation of the etchant. Each of the first solution and the second solution may contain the above optional components as needed.

In one or more embodiments, the kit of the present disclosure may be a kit (two-part etchant) that includes a mixed acid composition (first solution a) containing phosphoric acid, nitric acid, and organic acid and a solution (second solution a) containing an etching inhibitor so that the two solutions are not mixed with each other. The first solution a and the second solution a are mixed at the time of use. After the first solution a and the second solution a are mixed together, the mixed solution may be diluted with water or an acid aqueous solution as needed. The first solution a or the second solution a may contain the whole or part of the amount of water used for the preparation of the etchant. The acid contained in the first solution a may correspond to the whole or part of the amount of the acid used for the preparation of the etchant. The second solution a may contain acid. Each of the first solution a and the second solution a may contain the above optional components as needed.

The kit of the present disclosure provides an etchant that is able to reduce dripping during the filling of a container with the etchant and also to increase the filtration rate.

In one or more embodiments, the etchant composition of the present disclosure can be used to etch metals in the manufacturing process of electronic devices, particularly semiconductor wafers.

In one or more embodiments, the etchant composition of the present disclosure can be suitably used for the production of at least one substrate selected from the group consisting of a semiconductor wafer, a substrate for a liquid crystal display, a substrate for a plasma display, a substrate for an FED (field emission display), a substrate for an optical disk, a substrate for a magnetic disk, a substrate for a magneto-optical disk, a substrate for a photomask, a ceramic substrate, and a substrate for a solar cell.

In one or more embodiments, the etchant composition of the present disclosure can be used to etch electrodes in the manufacturing process of electronic devices, particularly semiconductor memories such as nonvolatile memories including NAND flash memories.

In one or more embodiments, the etchant composition of the present disclosure can be suitably used for the production of three-dimensional structure patterns. This can provide sophisticated devices such as large-capacity memories.

The etchant composition of the present disclosure can be used for the etching method as disclosed in, e.g., JP 2020-145412 A

Etchant Composition in Container

In one aspect, the present disclosure is based on the findings that it is possible to reduce dripping when an etchant in a container is taken out of the container, provided that the etchant in the container contains phosphoric acid, nitric acid, organic acid, an etching inhibitor, and water, the viscosity of the etchant at 25° C. is within a predetermined range, and the contact angles (advancing contact angle, advancing contact angle/receding contact angle) of the etchant with respect to the raw material of the container falls in a predetermined range.

In one aspect, the present disclosure relates to an etchant composition in a container, including the etchant composition with which the container is filled (also referred to as an "etchant composition in a container of the present disclosure" in the following). The etchant composition is used to etch a metal film that is disposed on a substrate. The etchant composition contains phosphoric acid, nitric acid, organic acid, an etching inhibitor, and water and has a viscosity of 11 mPa·s or more and less than 40 mPa·s at 25° C. The receding contact angle of the etchant composition with respect to the raw material of the container is 60° or more, and the ratio of the advancing contact angle to the receding contact angle (advancing contact angle/receding contact angle) of the etchant composition is 1.4 or less.

In one or more embodiments, the present disclosure can reduce dripping when the etchant in a container is taken out of the container.

In one or more embodiments, the etchant composition in a container of the present disclosure may include the etchant composition of the present disclosure, with which the container is filled.

The container used for the etchant composition in a container of the present disclosure may be a container to be filled with the etchant composition of the present disclosure.

In one or more embodiments, the etchant composition in a container of the present disclosure can be produced by the production method of an etchant of the present disclosure. For example, the etchant composition in a container of the present disclosure can be produced by filling the container 6 with the etchant composition of the present disclosure through the filling system as illustrated in FIG. 1. The details of the filling system in FIG. 1 are as described above.

Contact Angle of Etchant with Respect to Raw Material (Material) of Container Regarding the etchant composition in a container of the present disclosure, the receding contact angle of the etchant composition in the container with respect to the raw material of the container is 60° or more, and the ratio of the advancing contact angle to the receding contact angle (advancing contact angle/receding contact angle) of the etchant composition is 1.4 or less from the viewpoint of reducing dripping. The preferred values of the advancing contact angle, the receding contact angle, and the advancing contact angle/receding contact angle ratio of the etchant composition with respect to the raw material of the container may be the same as the preferred values of the advancing contact angle, the receding contact angle, and the advancing contact angle/receding contact angle ratio of the etchant composition with respect to the raw material of the filling port of the filling nozzle, as described above.

In the present disclosure, the contact angles of the etchant composition with respect to the raw material of the container can be measured in the same manner as the measurement method of the contact angles of the etchant composition with respect to the raw material of the filling port of the filling nozzle.

EXAMPLES

Hereinafter, the present disclosure will be described in detail by way of examples. However, the present disclosure is not limited to the following examples.

1. Preparation of Etchant (Examples 1 to 12, Comparative Examples 1 to 6)

Etchants (pH: −2 to 0) of Examples 1 to 12 and Comparative Examples 1 to 6 were prepared by blending phosphoric acid, nitric acid, the organic acid shown in Tables 1 to 2, the etching inhibitor shown in Tables 1 to 2, and water. Tables 1 to 2 show the blending amount (% by mass, active part) of each component in each of the etchants thus prepared. In Tables 1 to 2, the blending amount of water also includes the amount of water contained in, e.g., the acid aqueous solution.

The etchants were prepared by using the following components.

Phosphoric acid [concentration: 85%, manufactured by RIN KAGAKU KOGYO CO., LTD.]

Nitric acid [concentration: 70%, manufactured by FUJIFILM Wako Pure Chemical Corporation]

Organic Acid

Acetic acid [concentration: 100%, manufactured by FUJIFILM Wako Pure Chemical Corporation]

Etching Inhibitor

Polyethyleneimine [number average molecular weight: 1,800, "EPOMIN SP-018" manufactured by NIPPON SHOKUBAI CO., LTD.]

Diethylenetriamine [molecular weight: 103, "DETA" manufactured by Tosoh Corporation]

Water

Water [ultrapure water produced by using a continuous pure water production system (PURECONTI PC-2000VRL) and a subsystem (MAKUACE KC-05H), both manufactured by Kurita Water Industries Ltd.]

2. Method for Measuring Each Parameter pH of Etchant

The pH value of the etchant at 25° C. was measured with a pH meter (manufactured by DKK-TOA CORPORATION). Specifically, the pH value was obtained 1 minute after the electrode of the pH meter was immersed in the etchant.

Viscosity of Etchant

The viscosity of the etchant was measured with the following viscometer under the following conditions.

Device name: TVB-10 viscometer (with thermostat) manufactured by Toki Sangyo Co., Ltd.

Rotor: spindle No. M1, cord No. 20

Rotation speed: 100 rpm, measuring a viscosity after 60 seconds

Temperature: 25° C.

Advancing Contact Angle, Receding Contact Angle, and Advancing Contact Angle/Receding Contact Angle Ratio of Etchant Composition with Respect to Raw Material of Filling Port of Filling Nozzle The advancing contact angle and the receding contact angle of the etchant composition with respect to the raw material of the filling port of the filling nozzle were measured with the following measuring device under the following conditions.

Device name: K-100 manufactured by KRUSS GmbH

Size of sample plate: 20 (mm)×50 (mm)×2 (mm)

Raw material (material) of sample plate: raw materials shown in Tables 1 to 2 [PTFE (polytetrafluoroethylene), PFA (perfluoroalkoxyalkane), PP (polypropylene), PE (polyethylene), and PVC (polyvinyl chloride)]

Immersion liquid: etchant composition

Measurement Conditions

Temperature: 25° C.

Measuring speed: 1 mm/min

Maximum immersion depth: 5 mm

Minimum immersion depth: 1 mm

Number of measurements: 3

Data acquisition step: 0.2 mm

Analysis Method

The results of the third measurement were plotted on a graph of force vs. immersion depth, and the contact angles were calculated from the slopes of the graph.

Operation Method

The contact angle of the leading edge (advancing contact angle) was measured when a sample plate was gradually immersed into the etchant composition. Moreover, the contact angle of the trailing edge (receding contact angle) was measured when the immersed sample plate was gradually pulled out of the etchant composition. Then, the ratio of the advancing contact angle to the receding contact angle (advancing contact angle/receding contact angle) was calculated. Tables 1 to 2 show the results.

3. Evaluation of Etchant

Etchant compositions in containers of Examples 1 to 12 and Comparative Examples 1 to 6 were produced by filling the containers with the respective etchant compositions thus prepared through the filling system in FIG. 1 under the following conditions. Each of the etchant compositions in the containers was evaluated as follows. Tables 1 to 2 show the results.

As illustrated in FIG. 1, the filling system includes a tank 1 for storing the etchant composition, a pump 2 for delivering the etchant composition, a filter 3 for filtering the etchant composition, an outlet valve 4 for controlling the flow rate of the etchant composition that is discharged from an outlet (filling nozzle) 5, and a pipe P1 for connecting the tank 1, the pump 2, the filter 3, the outlet valve 4, and the outlet (filling nozzle) 5. The filling system also includes a circulation path P2 that branches off from the pipe P1 between the filter 3 and the outlet valve 4 and is connected to the upstream side of the pump 2. The filling system further includes a circulation valve 7 for controlling the flow rate of the etchant composition that is circulated in the circulation path P2.

First, the etchant composition was placed in the tank 1. Then, the etchant composition in the tank 1 was supplied by the pump 2 and filtered through the filter 3. Subsequently, the etchant composition after filtration was discharged from the filling port of the outlet (filling nozzle) 5 and injected into the container 6 through the opening.

Filling System

Pump 2: diaphragm pump DP-10BPT (manufactured by Yamada Corporation)

Pipe P1, P2: corrugated flexible hose 15A (manufactured by Flonchemical, Co., Ltd.)

Filter 3: membrane filter

Outlet (filling nozzle) 5: outer diameter 14 mm, raw material of the filling port of the filling nozzle: PTFE Container 6: 20 L resin container Conditions Filtration temperature: 25° C.

Filtration pressure: 0.3 MPa

Filtration flow rate: 0.1 to 20 kg/($m^2$ min)

Scale: 300 kg of etchant composition

Filling flow rate: 0.1 to 20 kg/($m^2$ min)

Circulation flow rate: 0.1 to 20 kg/($m^2$ min)

Number of Times of Dripping During Filling

After the container 6 was filled with a predetermined amount of the etchant composition through the filling system in FIG. 1 under the above conditions, the outlet (filling nozzle) 5 was withdrawn from the opening of the container 6 in preparation for the next filling of an empty container. At this time, the etchant composition was evaluated by determining how frequently it dripped around the opening or the wall surface of the container 6. Tables 1 to 2 show the frequency of occurrence of dripping (i.e., the number of times of dripping) when the above operation was repeated 10 times. The results show that the fewer the number of times the dripping occurs, the more reduced the dripping.

Evaluation of Permeability

The unfiltered etchant composition flowed through a predetermined filter (hydrophilic PTFE 0.20 (pore size) μm filter, type: 25HP020AN, manufactured by ADVANTEC) at a liquid temperature of 25° C. and a constant air pressure of 0.30 MPa. The amount of flow (g/min) of the etchant composition through the filter during the first 1 minute was determined and shown in Table 1. In this case, the amount of the etchant composition that has passed through the 0.20 μm filter under the above conditions may be used as an indicator of the filtration rate when a container is filled with the etchant composition. Thus, the higher the amount of flow through the filter, the faster the etchant composition can be filtered.

Evaluation of Productivity

The productivity of the etchant composition can be evaluated by the combination of the filtration rate, i.e., the filter permeability and the frequency of dripping during filling. For example, if the filter permeability is good, and the frequency of dripping during filling is very low, the etchant composition requires less wiping to remove drips from around the opening or the wall surface of the container, and can be rated "A", indicating extremely high productivity. On the other hand, if the filter permeability is good, and the frequency of dripping during filling is very high, the etchant composition requires much more wiping to remove drips from around the opening or the wall surface of the container, and can be rated "D", indicating extremely low productivity. In this manner, the etchant compositions were graded on a four-point scale. Table 1 shows the results.

Evaluation Criteria

A: The etchant composition provides good filter permeability and requires almost no wiping, resulting in extremely high productivity.

B: The etchant composition provides good filter permeability and requires less wiping, resulting in high productivity.

C: The etchant composition requires almost no wiping, but provides poor filter permeability, resulting in low productivity.

D: The etchant composition provides good filter permeability, but requires more wiping, which causes frequent interruptions in the operation, resulting in extremely low productivity.

TABLE 1

| | Etchant composition | | | | | | | Contact angle of etchant composition with respect to raw material (PTFE) of filling port | | | | Amount of flow | |
|---|---|---|---|---|---|---|---|---|---|---|---|---|---|
| | Composition (mass %) | | | | | | | | | | | | |
| | | | Organic | Etching inhibitor | | | Viscos- | | | Advancing contact | Number of | through filter | |
| | Phos- phoric acid | Nitric acid | acid Acetic acid | Poly- ethyl- eneimine | Dieth- ylene- triamine | Water | ity (mPa · s) 25° C. | Advancing contact angle | Receding contact angle | angle/ Receding contact angle | times of dripping during filling | (g/min) 0.2 μm filter, 25° C. | Produc- tivity |
| Ex. 1 | 62.0 | 5.0 | 15.0 | 1.0 | — | 17.0 | 37 | 93.5° | 76.0° | 1.2 | 0 | 20.2 | A |
| Ex. 2 | 57.0 | 5.0 | 20.0 | 1.0 | — | 17.0 | 33 | 91.2° | 74.1° | 1.2 | 1 | 21.3 | A |
| Ex. 3 | 47.0 | 5.0 | 30.0 | 1.0 | — | 17.0 | 26 | 87.1° | 70.2° | 1.2 | 1 | 22.7 | A |
| Ex. 4 | 37.0 | 5.0 | 40.0 | 1.0 | — | 17.0 | 18 | 83.0° | 65.3° | 1.3 | 3 | 26.5 | B |
| Ex. 5 | 27.0 | 5.0 | 50.0 | 1.0 | — | 17.0 | 15 | 78.9° | 61.6° | 1.3 | 4 | 29.1 | B |
| Ex. 6 | 57.0 | 5.0 | 20.0 | — | 1.0 | 17.0 | 33 | 91.2° | 74.1° | 1.2 | 1 | 22.4 | A |
| Ex. 7 | 27.0 | 5.0 | 50.0 | — | 1.0 | 17.0 | 13 | 79.0° | 63.4° | 1.3 | 4 | 29.8 | B |
| Ex. 8 | 72.0 | 5.0 | 5.0 | 1.0 | — | 17.0 | 41 | 94.6° | 77.5° | 1.2 | 0 | 15.4 | C |
| Ex. 9 | 67.0 | 5.0 | 10.0 | 1.0 | — | 17.0 | 40 | 93.8° | 76.3° | 1.2 | 0 | 14.9 | C |
| Comp. Ex. 1 | 17.0 | 5.0 | 60.0 | 1.0 | — | 17.0 | 10 | 75.0° | 56.4° | 1.3 | 5 | 71.2 | D |

TABLE 2

| | Etchant composition | | | | | | | Contact angle of etchant composition with respect to raw material of filling port | | | | |
|---|---|---|---|---|---|---|---|---|---|---|---|---|
| | Composition (mass %) | | | | | | | | | | | |
| | | | Organic | Etching inhibitor | | | Viscos- | Raw | | | Advancing contact angle/ | Number of times of |
| | Phos-phoric acid | Nitric acid | acid Acetic acid | Poly-ethyl-eneimine | Dieth-ylene-triamine | Water | ity (mPa · s) 25° C. | material of filling port | Advancing contact angle | Receding contact angle | Receding contact angle | dripping during filling |
| Ex. 1 | 62.0 | 5.0 | 15.0 | 1.0 | — | 17.0 | 37 | PTFE | 93.5° | 76.0° | 1.2 | 0 |
| Ex. 10 | | | | | | | | PFA | 89.7° | 72.2° | 1.2 | 0 |
| Ex. 11 | | | | | | | | PP | 79.3° | 60.5° | 1.3 | 4 |
| Comp. Ex. 2 | | | | | | | | PE | 77.9° | 48.0° | 1.6 | 6 |
| Comp. Ex. 3 | | | | | | | | PVC | 62.9° | 38.6° | 1.6 | 7 |
| Ex. 7 | 27.0 | 5.0 | 50.0 | — | 1.0 | 17.0 | 13 | PTFE | 79.0° | 63.4° | 1.3 | 4 |
| Ex. 12 | | | | | | | | PFA | 74.9° | 60.9° | 1.2 | 4 |
| Comp. Ex. 4 | | | | | | | | PP | 60.3° | 40.2° | 1.5 | 8 |
| Comp. Ex. 5 | | | | | | | | PE | 40.2° | 0.10° | 402.1 | 10 |
| Comp. Ex 6 | | | | | | | | PVC | 37.5° | 20.5° | 1.8 | 9 |

As shown in Table 1, the etchants of Examples 1 to 9, which meet the following conditions: the receding contact angle of the etchant with respect to the raw material of the filling port of the filling nozzle is 60° or more; and the ratio of the advancing contact angle to the receding contact angle (advancing contact angle/receding contact angle) of the etchant is 1.4 or less, each reduce the number of times the dripping occurs, and thus ensure resistance to dripping during the filling of the container with the etchant.

The etchants of Examples 1 to 7, which contain phosphoric acid, nitric acid, organic acid, and an etching inhibitor and have a viscosity of 11 mPa·s or more and less than 40 mPa·s at 25° C., each reduce dripping during the filling of the container with the etchant and increase the filtration rate, providing high productivity, compared to the etchants of Examples 8 to 9, which contain phosphoric acid, nitric acid, organic acid, and an etching inhibitor and have a viscosity of 40 mPa·s or more at 25° C., and the etchant of Comparative Examples 1, which contains phosphoric acid, nitric acid, organic acid, and an etching inhibitor and has a viscosity of less than 11 mPa·s at 25° C.

As shown in Table 2, the etchants of Examples 1, 10 to 11, 7, and 12, which meet the following conditions the receding contact angle of the etchant with respect to the raw material of the filling port of the filling nozzle is 60° or more; and the ratio of the advancing contact angle to the receding contact angle (advancing contact angle/receding contact angle) of the etchant is 1.4 or less, each reduce the number of times the dripping occurs, and thus ensure resistance to dripping during the filling of the container with the etchant, compared to the etchants of Comparative Examples 2 to 6, which fail to meet these conditions.

INDUSTRIAL APPLICABILITY

The etchant composition of the present disclosure is useful for etching a metal film on a substrate such as a semiconductor wafer, a substrate for a liquid crystal display, a substrate for a plasma display, a substrate for an FED (field emission display), a substrate for an optical disk, a substrate for a magnetic disk, a substrate for a magneto-optical disk, a substrate for a photomask, a ceramic substrate, or a substrate for a solar cell.

DESCRIPTION OF REFERENCE NUMERALS

1: tank, 2: pump, 3: filter, 4: outlet valve, 5: outlet (filling nozzle), 6: container, 7: circulation valve, P1: pipe, P2: circulation path

The invention claimed is:

1. A method comprising:

filling a container with an etchant composition by using a filling nozzle with a filling port through which the etchant composition is discharged, wherein the etchant composition contains phosphoric acid, nitric acid, organic acid, an etching inhibitor, and water, wherein a raw material of the filling port of the filling nozzle is at least one selected from the group consisting of polypropylene, perfluoroalkoxyalkane, and polytetrafluoroethylene, wherein a receding contact angle of the etchant composition with respect to the raw material of the filling port of the filling nozzle is 66° or more, and a ratio of an advancing contact angle to a receding contact angle (advancing contact angle/receding contact angle) of the etchant composition is 1.4 or less.

2. The method according to claim 1, wherein the etchant composition has a viscosity of 11 mPa·s or more and less than 40 mPa·s at 25° C.

3. The method according to claim 1, wherein the organic acid includes acetic acid.

4. The method according to claim 1, wherein a blending amount of the organic acid is 11% by mass or more and 59% by mass or less.

5. The method according to claim 1, comprising:

blending a mixed acid composition containing phosphoric acid, nitric acid, and organic acid with the etching inhibitor to provide the etchant composition.

6. The method according to claim 1, wherein the etching inhibitor is at least one nitrogen-containing compound selected from the group consisting of polyalkyleneimine and polyalkylene polyamine.

7. The method according to claim 1, wherein the etchant composition does not contain an azole compound.

8. The method according to claim 1, wherein the etchant composition does not contain hydrogen peroxide.

9. The method according to claim 1, wherein the etchant composition does not contain a fluorine compound.

10. The method according to claim 1, wherein the etchant composition has a pH of 1 or less.

11. An etching method comprising:

filling a container with an etchant composition by using a filling nozzle with a filling port through which the etchant composition is discharged, etching a metal film that is disposed on a substrate with the etchant composition, wherein the etchant composition contains phosphoric acid, nitric acid, organic acid, an etching inhibitor, and water, wherein a raw material of the filling port of the filling nozzle is at least one selected from the group consisting of polypropylene, perfluoroalkoxyalkane, and polytetrafluoroethylene, wherein a receding contact angle of the etchant composition with respect to the raw material of the filling port of the filling nozzle is 66° or more, and a ratio of an advancing contact angle to a receding contact angle (advancing contact angle/receding contact angle) of the etchant composition is 1.4 or less, and wherein the metal film contains at least one metal selected from the group consisting of tungsten, tantalum, zirconium, hafnium, molybdenum, niobium, ruthenium, osmium, rhenium, rhodium, copper, nickel, cobalt, titanium, titanium nitride, alumina, aluminum, and iridium.

12. The etching method according to claim 11, wherein the substrate is at least one substrate selected from the group consisting of a semiconductor wafer, a substrate for a liquid crystal display, a substrate for a plasma display, a substrate for a field emission display, a substrate for an optical disk, a substrate for a magnetic disk, a substrate for a magneto-optical disk, a substrate for a photomask, a ceramic substrate, and a substrate for a solar cell.

13. A method for producing an etchant composition, comprising:

mixing phosphoric acid, nitric acid, organic acid, an etching inhibitor, and water to produce the etchant composition, and filling a container with the etchant composition by using a filling nozzle with a filling port through which the etchant composition is discharged, wherein the etchant composition contains the phosphoric acid, the nitric acid, the organic acid, the etching inhibitor, and water, wherein a raw material of the filling port of the filling nozzle is at least one selected from the group consisting of polypropylene, perfluoroalkoxyalkane, and polytetrafluoroethylene, and wherein a receding contact angle of the etchant composition with respect to the raw material of the filling port of the filling nozzle is 66° or more, and a ratio of an advancing contact angle to a receding contact angle (advancing contact angle/receding contact angle) of the etchant composition is 1.4 or less.

* * * * *